United States Patent [19]

Uchida

[11] 3,941,416

[45] Mar. 2, 1976

[54] FOLDING CHAIR

[75] Inventor: Suekichi Uchida, Aichi, Japan

[73] Assignee: Uchida Sharyo Co., Ltd., Nagoya, Japan

[22] Filed: June 24, 1974

[21] Appl. No.: 482,522

[30] Foreign Application Priority Data

Feb. 19, 1974 Japan ..... 49-20012[U]

[52] U.S. Cl. ..... 297/45; 297/313

[51] Int. Cl.[2] ..... A47C 4/28

[58] Field of Search ..... 297/18, 19, 21, 29, 42, 297/44, 45, 56, 313, 314, 345, 443, 444; 248/164, 165

[56] References Cited

UNITED STATES PATENTS

| | | | |
|---|---|---|---|
| 3,730,584 | 5/1973 | Uchida | 297/45 |
| 3,851,914 | 12/1974 | Nii | 297/45 |

FOREIGN PATENTS OR APPLICATIONS

| | | | |
|---|---|---|---|
| 834,278 | 11/1938 | France | 297/45 |
| 319,169 | 3/1957 | Switzerland | 297/45 |
| 370,542 | 8/1963 | Switzerland | 297/45 |

*Primary Examiner*—Roy D. Frazier
*Assistant Examiner*—William E. Lyddane
*Attorney, Agent, or Firm*—Flynn & Frishauf

[57] ABSTRACT

A folding chair having a pair of X-shaped cross leg braces wherein the front and rear upper end portions of the leg braces are respectively connected to the front and rear end portions of a pair of arm rest bars by connecting means so as to cause them to swing relative to each other. When the folding operation of the chair is performed by each connecting means, both arm rest bars can approach each other in a manner that two planes including the respective arm rest bar are parallel to each other. The inclination of the seat can be varied by manually operating the connecting means on the back of the chair.

6 Claims, 7 Drawing Figures

FOLDING CHAIR

BACKGROUND OF THE INVENTION

The present invention relates to a folding chair which can be used as a simplified chair for outdoor as well as indoor uses. Particularly, this folding chair has its frame made of tubular steel and comprises a pair of X-shaped cross leg braces in its frame. The chair can be folded by folding the leg braces.

Well-known folding chairs of this type were found to be difficult to mount the back rest and arm rest with a sufficiently wide spacing as in the unfolding chair in view of the folding mechanism. This is because sufficient folding cannot be effected unless the planes including a pair of arm rest bars and a pair of seat supporting bars for seat supporting can approach each other, keeping parallel to each other. However, it was anything but easy to combine parallelism between the arm rest and the seat supporting bar with a pair of X-shaped cross braces. That is the main reason why the conventional folding chair was structurally incapable of sufficient folding or had a complicated folding mechanism and a high manufacturing cost.

SUMMARY OF THE INVENTION

Accordingly the general object of this invention is to provide an improved folding chair which is capable of eliminating the drawbacks of the prior art folding chair.

In one of the preferred embodiments of the invention, the front and rear end portions of a pair of arm rest bars for arm rest are connected to the upper end portions of the leg brace by connecting means. The arm rest bar can thus rock relative to the leg brace at and by the connecting means. A pair of seat supporting bars for seat supporting bars are L-shaped and secured in the slightly inclined L-shape with respect to the corresponding arm rest bars.

The relative position of connecting the rear end portion of the arm rest bar to the upper end portion of the leg brace can be displaced (or changed) by manually operating the connecting means for connecting the rear end portion of the arm rest bar to the upper end portion of the leg brace on the back of the chair, thereby varying the inclination of the seat for the user's choice.

Accordingly, the first object of this invention is to provide a folding chair of a tubular frame, which is simple in construction and low in manufacturing cost.

The second object of the invention is to provide a functionally excellent folding chair which is capable of folding with high degree of accuracy.

The third object of the invention is to provide a folding chair capable of suitably varying the inclinations of its seat and back rest by the user's choice.

DESCRIPTION OF THE PREFERRED EMBODIMENTS

Figure 1:
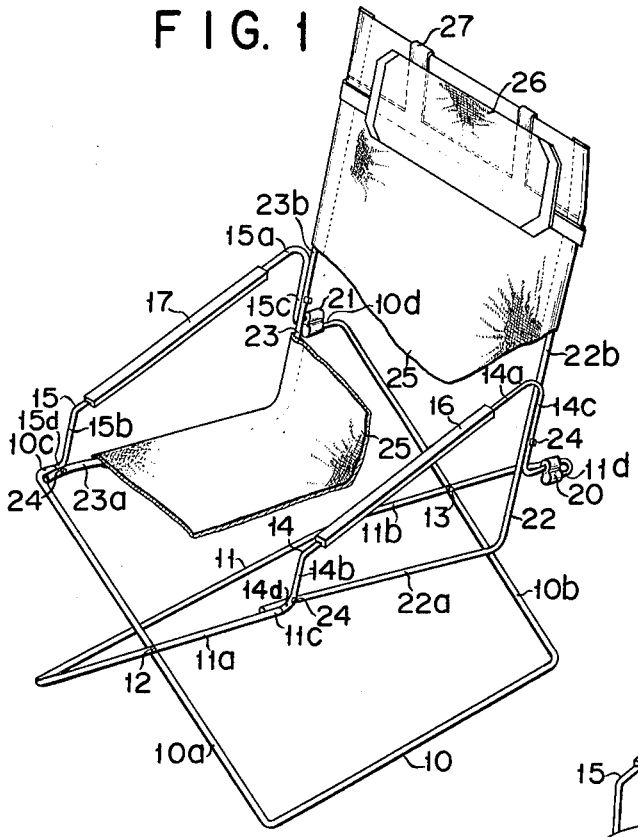
FIG. 1 is a perspective view showing a folding chair of the invention with its seat partially broken away.

FIG. 1 shows a folding chair when in use according t this invention. A pair of leg braces 10, 11 are made tubular steel pipe in an angular U-shape. Both le braces 10, 11 are respectively pivotally secured wit the front sloping portions 10*a*, 11*a* and rear slopin portions 10*b*, 11*b* intersecting at intersections 12, 13 i an X-shape. The upper end portions 10*c*, 11*c* of th front sloping portions 10*a*, 11*a* are bent rearward substantially right angles, extending horizontally. Th upper end portions 10*d*, 11*d* of the rear sloping po tions 10*b*, 11*b* are bent forward at substantially rigl angles, extending horizontally.

A pair of arm rest bars 14, 15 are made of tubul steel pipe. Arm rest members 16, 17 are made of pla tics material and rigidly secured to the sloping portior 14*a*, 15*a* by suitable means. In the case of a simpler an less expensive chair, however, the arm rest membei 16, 17 can be dispensed with the front portions 14 15*b* and rear portions 14*c*, 15*c* of the arm rest bars 1 15 are bent with respect to the sloping portions 14 15*a* so as to hang. The front end portions 14*d*, 15*d* a bent with respect to the hanging front portions 14 15*b*, extending forward in the horizontal direction. O the other hand, the rear end portions 14*e*, 15*e* are be with respect to the hanging rear end portions 14*c*, 15 extending backward in the horizontal direction. Th horizontal front portions 14*d*, 15*d* of the arm rest ba 14, 15 respectively correspond to the horizontal upp portions 11*c*, 10 *c* of the leg braces 10, 11.

Figure 3:
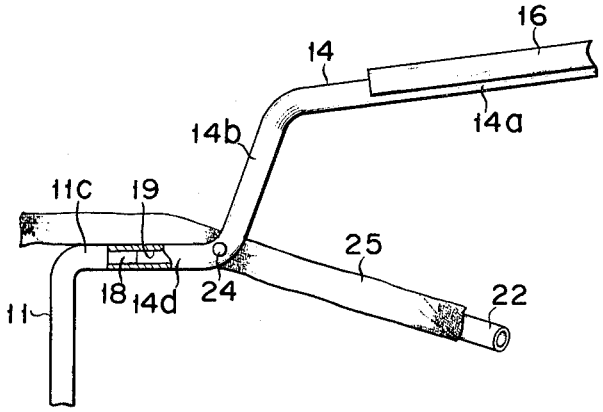
FIG. 3 is an enlarged view showing the essential parts of FIG. 1 to explain connection between the tip of the arm rest bar and the upper end portion of the leg brace.

Referring now to FIG. 3, a round pinlike projectic 18 extending axially from the end surface of the le brace 11 is fixedly attached to the tip of its horizont upper end portion 11*c*. This projection 18 is fitted inserted from the end surface of the front end portic 14*d* into a hole 19 (perforated along the shaft of th front end portion 14*d*) in the front end portion 14*d* the arm rest bar 14. The front end portion 14*d* abuts c the end surface of the upper end portion 11*c*. The fro end portion 14*d* and the upper end portion 11*c* a axially aligned by inserting the projection 18 into th hole 19. These two portions 14*d*, 11*c* can be relative rocked around the shaft so aligned. Exactly the sar explanation applies to the relationship between th upper end portion 10*c* of the leg brace 10 and the fro end portion 15*d* of the arm rest bar 15. The upper er portions 10*c*, 11*c* of the leg braces and the front er portions 14*d*, 15*d* of the arm rest bars 14, 15 can th be swung relatively (or independently) by connecti means constructed of the projection 18 and hole 1 Note that a modification of the connecting means ha ing the projection 18 from the horizontal front er portion and the corresponding hole in the horizont upper portion 10*c* can be easily designed.

On the other hand, the horizontal rear end portio 14*e*, 15*e* are respectively connected to the upper er portions 11*d*, 10*d* of the leg braces 11, 10 by connecting means 20, 21, as described below.

A pair of seat supporting bars 22, 23 are constructed of tubular steel pipe so that the substantially horizontal portions 22*a*, 23*a* and the substantially vertical portions 22*b*, 23*b* are united in one L-shaped body. One bar 22 is fixedly attached to the corresponding arm rest bar 14 by means of two bolts 24, 24. More exactly, one bolt 24 fixes the lower end of the front hanging portion 14*b* of the arm rest bar 14 and the horizontal portion 22*a* of the supporting bar 22, while the other bolt 24 fixes the rear hanging portion 14*c* of the arm rest bar 14 and the vertical portion 22*b* of the supporting bar 22. Exactly the same explanation applies to the bolt 24 which fixes the other supporting bar 23 and the arm rest bar 15. For the sake of clarity, therefore, the detailed description is omitted here.

A seat 25 is stretched out between a pair of seat supporting bars 22, 23. In greater detail, the seat 25 is attached by folding and sewing on the opposite side so as to wind the both sides of the seat about the corresponding bars 22, 23. This seat 25 is, for example, made of a flexible material, such as a vinyl leather material or canvas material. Note that although the seat 25 shown is a single one, including the back rest portion, the back rest portion made of a different material may also be separately used instead. A head rest 26 is placed on the upper end portion of the seat 25 incorporated into the back rest portion, which is stretched out between the vertical portions 22*b*, 23*b* of the seat supporting bars 22, 23. The head rest 26 is detachably mounted on the upper end portion of the seat 25 by a hanging band or belt sewed on the head rest 26 for the user's choice. This folding chair, when unused, that is folded, the head rest 26 is placed in its off-position.

In the folding chair, when in use, shown in FIG. 1, the seat 25 is fully stretched out by the seat supporting bars 22, 23 on both sides. In this case, a pair of arm rest bars 14, 15 are parallel to each other in the substantially vertical plane. Similarly, a pair of seat supporting bars 22, 23 are parallel to each other in the substantially vertical plane. And the seat supporting bars 22, 23 are of the slightly inclined L-shape from the side. Namely, the horizontal portions 22*a*, 23*a* are inclined downward from the front end to the rear end, while the vertical portions 22*b*, 23*b* are inclined backward from the lower end to the upper end. Therefore, the user can very comfortably sit in the seat 25.

The inclination of the seat supporting bars 22, 23 and also the inclination of the seat 25 can thus be varied by manually operating the connecting means 20, 21.

Figure 4:
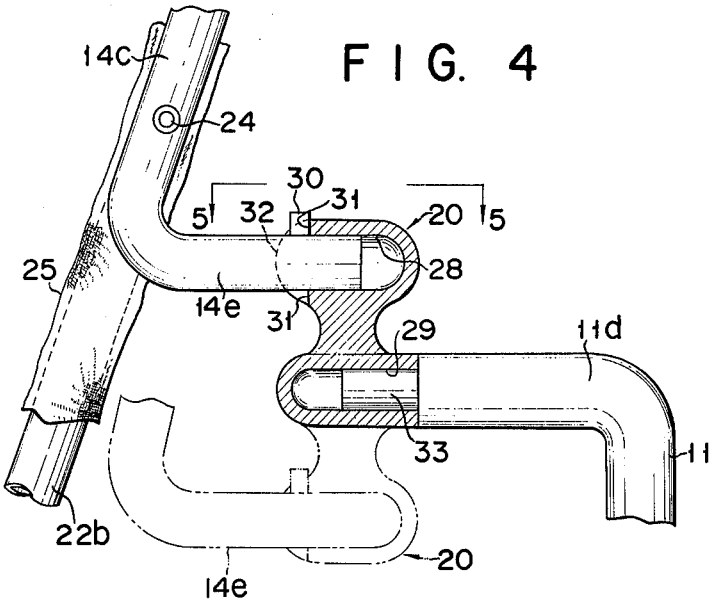
FIG. 4 is an enlarged view, partially broken away, of the folding chair shown in FIG. 1 to explain connection between the rear end portion of the arm rest bar and the upper end portion of the leg brace.
Figure 5:
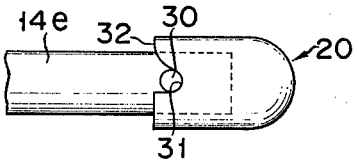
FIG. 5 is a view illustrating the essential parts of FIG 4 in the direction shown by the arrow, taken along th line 5—5 of FIG. 4.

Referring now to FIGS. 4 and 5, the construction of the connecting means 20, 21 will be described in greater detail. The connecting means 20 has two blind holes 28, 29 with openings in the mutually opposite directions. The holes 28, 29 parallel to each other are horizontally extending in the axial direction. The horizontal rear end portion 14*e* of the arm rest bar 14 is rotatably inserted in the upper hole 28. A round pin 30 is radially extending in the direction perpendicular to the axis of the rear end portion 14*e* on the peripheral surface of the horizontal rear end portion 14*d*. On the other hand, a recess 31 in succession to a cam surface 32 is formed at the end surface of the annular opening of the hole 28 perforated in the connecting means 20. The pin 30 normally engages the recess 31 to prevent the horizontal end portion 14*d* from relatively rotating in the hole 28. Note that two recesses 31, 31 are formed so as to correspond to the diametral direction on the end surface of the annular opening of the hole 28, and that the cam surface 32 is formed in half portion of the end surface of the annular opening.

On the other hand, a round pinlike projection 33 rigidly secured by the tip of the horizontal upper end portion 11*d* of the leg brace 11 is rotatably inserted in the lower hole 29. The projection 33 extends in the axial direction of the horizontal upper end portion 11*d*. Hence the axis of the hole 29 is in alignment with that of the upper end portion 11*d*.

In the state of FIG. 4, the horizontal rear end portion 14*e* is formed diagonally in a position higher than the horizontal upper end portion 11*d* with a predetermined spacing. Under this condition, if the user occupies the seat 25, a downward force will be exerted through the seat supporting bar 22 and bolt 24. Since, however, the pin 30 on the rear end portion 14*e* is sufficiently inserted in the recess 31, the connecting means 20 will be maintained in the position shown.

If, however, the user unidirectionally rotates the connecting means 20 around the projection 33 while slightly withdrawing the horizontal rear end portion 14*e* from the hole 28 by hand, the pin 30 will be disengaged from the recess 31 and slide on the cam surface 32 by cam action. Therefore, the connecting means 20 will be displaced from the position shown solid to the position shown dotted, while the pin 30 will engage the other recess 31. As a result, the horizontal rear end portion 14*e* will be lowered up to the chain-line position. This means to vary the inclination of the seat supporting bars 22, 23 and also of the seat 25. The inclination of the seat can thus be suitably varied by the user's choice. In the construction shown, the inclination can be varied by two steps.

Note that a similar operation has only to be performed to return the connecting means 20 from the chain-line position to the solid-line position, and that it is extremely easy to slightly withdraw the horizontal rear end portion 14*e* from the hole 28 because of the slight flexibility of the tubular pipe of which the frame of the chair is made.

Figure 2:
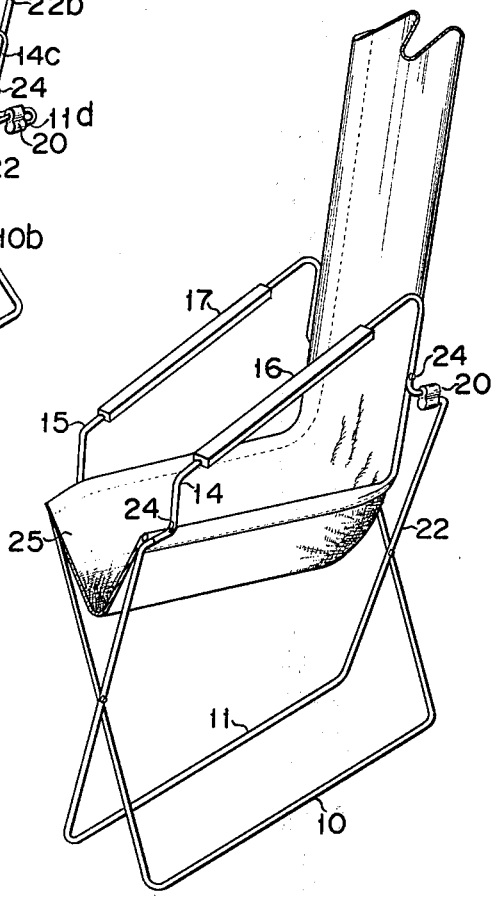
FIG. 2 is a perspective view illustrating the folding chair of FIG. 1 when folded incompletely.

This is as true of the other connecting means 21 as of the connecting means 20 in construction. Namely, the connecting means 21 makes interconnection between the horizontal rear end portion 15*e* of the arm rest bar 15 and the horizontal upper end portion 10*d* of the leg brace 10, securing suitable rockability and diagonal arrangement. And the user manually operates both connecting means 20, 21 as described above in one connecting means 20 taken as an example, thereby varying the inclination of the seat 25 in a balance on both sides (a balance on one side only will cause inclination). Note that the extremely smooth change of these two connecting means 20, 21 can be made to vary the inclination of the seat 25 by slightly folding the chair as shown in FIG. 2. Note also that, although the pin 30 shown in FIGS. 4 and 5 is formed in the horizontal rear end portions 14*e*, it is easy in design to form not only a pin 30 on the horizontal upper end portion 11*d* but also the cam surface and recess collaborating with the pin 30 on the periphery of the opening of the hole 29.

Figure 6:
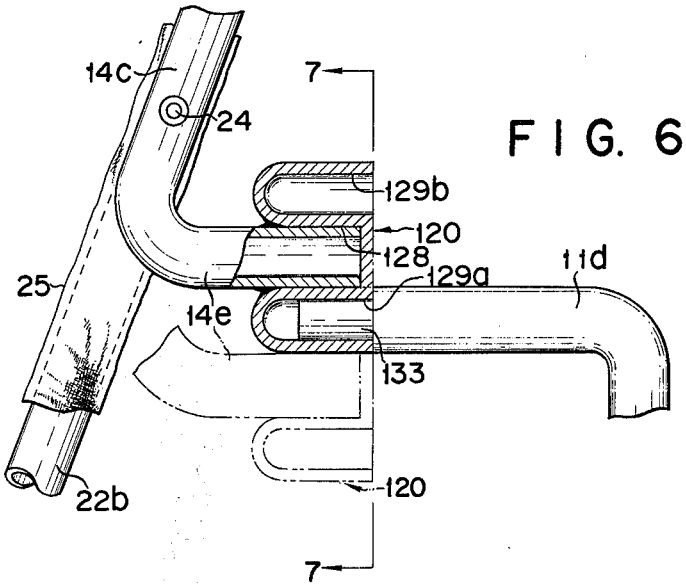
FIG. 6 is an enlarged view, partially broken away, t explain modification of connection between the re end portion of the arm rest bar and the upper en portion of the leg brace.
Figure 7:
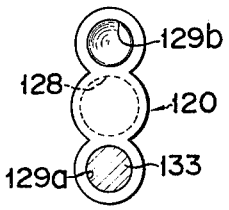
FIG. 7 illustrates the principal parts taken along th line 7—7 of FIG. 6.

FIGS. 6 and 7 illustrate another embodiment in which the connecting means 20 is replaced by a connecting means 120 having a different construction and suitable for the folding chair. This connecting means 120 has three blind holes 128, 129*a*, 129*b* with axes horizontal and parallel to one another. One blind hole 128 is open in the opposite direction to the other two holes 129*a*, 129*b*. As apparent in FIG. 7, these three holes 128, 129*a*, 129*b* are in vertical alignment.

The horizontal rear end portion 14*e* of the arm rest bar 14, as inserted in the hole 128, is united in one body to the connecting means 120 by welding, for instance. On the other hand, a pinlike projection 133 projects from the tip of the horizontal upper end portion 11*d* of the leg brace 11 so as to extend horizontally as shown in FIG. 4, and is rockably detachably inserted in the hole 129*a*. Namely, the horizontal rear end portion 14*e* is connected to the horizontal upper end portion 11*d* such that it is diagonally located with a predetermined spacing by the connecting means 120, as indicated in FIG. 6. The projection 133 can be disengaged from the hole 129*a* by horizontally withdrawing the horizontal rear end portion 14*e* and horizontal upper end portion 11*d* so as to be receding from each other. The connecting means 120, together with the horizontal rear end portion 14*e*, arm rest bar 14, and seat supporting bar 22, are then lowered so as to cause the projection in the original position to be opposed to, and inserted into, the hole 129*b*. The inclination of the seat 25 can thus be varied by inserting the projection 133 into the upper hole 129*b* instead of the lower hole 129*a*, as already explained about the connecting means 20 of FIG. 4.

Although the foregoing description (FIG. 6) refers to the application of the connecting means 120 to interconnection between the horizontal rear end portion 14*e* and horizontal upper end portion 11*d* on one side of the chair, needless to say, the same explanation applies to interconnection between the horizontal rear end portion 15*e* and horizontal upper end portion 10*d* on the other side of the chair.

In the embodiment of FIG. 6, two holes 129*a*, 129*b* are formed so as to allow the projection to selectively insert into these two holes by making two-step change in the inclination of the seat 25. However, a greater variation in the inclination of the seat 25 can be attained by perforating much more holes in different positions and by selectively inserting the projection 133 into each hole.

It is also easy in design to fix the connecting means 120 to the horizontal upper end portion 11*d* and to mount a projection detachably engaging a hole on the part of the horizontal rear end portion 14*e*.

The folding chair of the invention so constructed can be folded by shifting the unfolded state of FIG. 1 to the incompletely folded state of FIG. 2. In the folding operation the horizontal upper end portions 10*c* and 11*c* or 10*d* and 11*d* are approaching each other, varying the angle of intersection between a pair of leg braces 10, 11. On the other hand, a pair of arm rest bars 14, 15 and a pair of seat supporting bars 22, 23 can approach each other, forming mutually parallel planes. This is partly because the horizontal front end portions 14*d*, 15*d* of the arm rest bars 14, 15 can be rocked relative to the corresponding horizontal upper end portions 11*c*, 10*c* of the leg braces 11, 10 by the connecting means consisting of the aforementioned projection and holes, and partly because the horizontal rear end portions 14*e*, 15*e* of the arm rest bars 14, 15 can be swung with respect to the corresponding horizontal upper end portions 11*d*, 10*d* of the leg braces 11, 10 by the above-mentioned connecting means 20, 21 or 120. When folded completely, therefore, the left- and right-handed arm rest bars 14, 15 can approach each other until they make a close contact with each other. As a result, the folding chair of the invention has another advantage in compactness when unused. In addition, since the connecting means at front and rear of the chair is simple in construction, it is less expensive and less time-consuming in assembly.

What is claimed is:

1. A folding chair comprising:

a. a pair of generally U-shaped leg braces the legs of which are connected together to form a pair of X-shaped cross leg braces, said generally U-shaped leg braces each having a front upper end portion and a rear upper end portion, said upper end portions each having an axis extending substantially horizontally in mutually facing directions;

b. a pair of arm rest bars, each of said arm rest bars including a front section and a rear section, said front section having a front end portion with an axis extending forward in a substantially horizontal direction, and said rear section having a rear end portion with an axis extending backward in a substantially horizontal direction;

c. a pair of substantially L-shaped seat supporting bars, each of said seat supporting bars comprising a substantially horizontally extending portion which has front and rear ends and is inclined downward from the front end to the rear end, and a substantially vertically extending portion which has upper and lower ends and which is inclined backward from the lower end to the upper end;

d. a flexible seat mounted on said pair of seat supporting bars;

e. first fixing means for fixing said front section of said arm rest bar to said substantially horizontally extending portion of said seat supporting bar;

f. second fixing means for fixing said rear section of said arm rest bar to said substantially vertically extending portion of said seat supporting bar;

g. first connecting means for connecting said front end portion of said arm rest bar with said front upper end portion of said generally U-shaped leg brace such that one of the two can rock around its axis relative to the other; and h. second connecting means for connecting said rear end portion of said arm rest bar with said rear upper end portion of said generally U-shaped leg brace such that one of the two can rock around its axis relative to the other said second connecting means including:

1. a connecting member having a first hole and a second hole perforated substantially in the horizontal direction with a prescribed vertical spacing therebetween;

2. said first hole being engaged with said rear end portion of said arm rest bar so that said connecting member is rotatable about the axis of said first hole, and said second hole being engaged with said rear upper end portion of said generally U-shaped leg brace so that said connecting member is rotatable about the axis of said second hole;

3. a pin radially projecting from at least one of the rear end portion of said arm rest bar and the rear upper portion of said generally U-shaped leg brace;

4. said connecting member having a recess formed in the end surface of an annular opening of one of said first and second holes in which said one portion is inserted, said radially projecting pin normally releasably engaging said recess, thereby preventing said one portion from being rotated about its axis; and 5. said pin being adapted to be disengaged from said recess by slightly withdrawing said one portion from the inserted hole, thereby permitting said one portion to axially rotate in the inserted hole, resulting in variation in the relative height of said one portion with respect to the other.

2. A folding chair according to claim 1 wherein said pair of generally U-shaped leg braces, said pair of arm rest bars and said pair of seat supporting bars are made of tubular steel pipe.

3. A folding chair according to claim 1 wherein said first connecting means includes a pin-like projection extending axially from one of the front end portion of the arm rest bar and the front upper end portion of the generally U-shaped leg brace, and a hole perforated in the other along the axis so as to fittedly engage said projection; and wherein said projection is rockable around its axis with said projection inserted in said hole.

4. A folding chair comprising:

a. a pair of generally U-shaped leg braces the legs of which are connected together to form a pair of X-shaped cross leg braces, said generally U-shaped leg braces each having a front upper end portion and a rear upper end portion, said upper end portions each having an axis extending substantially horizontally in mutually facing directions;

b. a pair of arm rest bars, each of said arm rest bars including a front section and a rear section, said front section having a front end portion with an axis extending forward in a substantially horizontal direction, and said rear section having a rear end portion with an axis extending backward in a substantially horizontal direction;

c. a pair of substantially L-shaped seat supporting bars, each of said seat supporting bars comprising a substantially horizontally extending portion which has front and rear ends and is inclined downward from the front end to the rear end, and a substantially vertically extending portion which has upper and lower ends and which is inclined backward from the lower end to the upper end;

d. a flexible seat mounted on said pair of seat supporting bars;

e. first fixing means for fixing said front section of said arm rest bar to said substantially horizontally extending portion of said seat supporting bar;

f. second fixing means for fixing said rear section of said arm rest bar to said substantially vertically extending portion of said seat supporting bar;

g. first connecting means for connecting said front end portion of said arm rest bar with said front upper end portion of said generally U-shaped leg brace such that one of the two can rock around its axis relative to the other; and h. second connecting means for connecting said rear end portion of said arm rest bar with said rear upper end portion of said generally U-shaped leg brace such that one of the two can rock around its axis relative to the other said second connecting means including:

1. a connecting member having at least two holes of different relative heights perforated substantially in the horizontal direction with a predetermined vertical spacing therebetween;

2. said connecting member being fixedly attached to one of the rear end portion of said arm rest bar and the rear upper end portion of said generally U-shaped leg brace so that the axis of said one portion is parallel to those of said holes; and 3. the other of the rear end portion of said arm rest bar and the rear upper end portion of said generally U-shaped leg brace normally releasably engaging one of the holes in said member, the relative height between the rear end portion of said arm rest bar and the rear upper end portion of said generally U-shaped leg brace being varied by withdrawing said other portion from said engaged hole and inserting it into another hole.

5. A folding chair according to claim 4 wherein said pair of generally U-shaped leg braces, said pair of arm rest bars and said pair of seat supporting bars are made of tubular steel pipe.

6. A folding chair according to claim 4 wherein said first connecting means includes a pin-like projection extending axially fron one of the front end portion of the arm rest bar and the front upper end portion of the generally U-shaped leg brace, and a hole perforated in the other along the axis so as to fittedly engage said projection; and wherein said projection is rockable around its axis with said projection inserted in said hole.

* * * * *